US008249475B2

(12) United States Patent
Hagiwara

(10) Patent No.: US 8,249,475 B2
(45) Date of Patent: Aug. 21, 2012

(54) CHARGING DEVICE WITH VARIATION RANGE DETECTOR AND RESPONSE SPEED CONTROLLER AND IMAGE FORMING APPARATUS USING THE SAME

(75) Inventor: Takuro Hagiwara, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 315 days.

(21) Appl. No.: 12/701,886

(22) Filed: Feb. 8, 2010

(65) Prior Publication Data

US 2011/0069982 A1 Mar. 24, 2011

(30) Foreign Application Priority Data

Sep. 18, 2009 (JP) ..... 2009-218028

(51) Int. Cl.
*G03G 15/02* (2006.01)

(52) U.S. Cl. ..... 399/50

(58) Field of Classification Search ..... 399/50, 399/37, 88

See application file for complete search history.

(56) References Cited

U.S. PATENT DOCUMENTS

| | | | | |
|---|---|---|---|---|
| 5,689,460 | A * | 11/1997 | Ooishi | 365/189.07 |
| 6,014,529 | A * | 1/2000 | Sato | 399/50 |
| 7,483,644 | B2 * | 1/2009 | Uchiyama et al. | 399/37 |
| 2006/0245775 | A1 * | 11/2006 | Takahashi et al. | 399/50 |
| 2009/0269092 | A1 * | 10/2009 | Handa et al. | 399/50 |

FOREIGN PATENT DOCUMENTS

| | | | |
|---|---|---|---|
| JP | 2003-140446 | A | 5/2003 |
| JP | 2006-039133 | A | 2/2006 |

* cited by examiner

*Primary Examiner* — David Gray
*Assistant Examiner* — G. M. Hyder
(74) *Attorney, Agent, or Firm* — Sughrue Mion, PLLC

(57) ABSTRACT

A charging device includes: a charging member that faces an image carrier and charges a surface of the image carrier; a charging voltage controller that controls a charging voltage to be applied to the charging member when the surface of the image carrier is to be charged, and applies the charging voltage obtained by superposing an AC voltage which is subjected to constant-current control on a DC voltage; a variation range detector that detects a variation range of the AC voltage which changes according to the characteristic change of the charging member; and a response speed controller that reduces a response speed for the variation of the AC voltage in correspondence with the characteristic change when the variation range is larger than a predetermined set value.

2 Claims, 8 Drawing Sheets

CHARGING DEVICE WITH VARIATION RANGE DETECTOR AND RESPONSE SPEED CONTROLLER AND IMAGE FORMING APPARATUS USING THE SAME

CROSS-REFERENCE TO RELATED APPLICATIONS

This application is based on and claims priority under 35 USC 119 from Japanese Patent Application No. 2009-218028 filed Sep. 18, 2009.

BACKGROUND

Technical Field

The present invention relates to a charging device and an image forming apparatus using the same.

SUMMARY

According to an aspect of the invention, there is provided a charging device including: a charging member that faces an image carrier and charges a surface of the image carrier; a charging voltage controller that controls a charging voltage to be applied to the charging member when the surface of the image carrier is to be charged, and applies the charging voltage obtained by superposing an AC voltage which is subjected to constant-current control on a DC voltage; a variation range detector that detects a variation range of the AC voltage which changes according to the characteristic change of the charging member; and a response speed controller that reduces a response speed for the variation of the AC voltage in correspondence with the characteristic change when the variation range is larger than a predetermined set value.

BRIEF DESCRIPTION OF THE DRAWINGS

An exemplary embodiment of the present invention will be described in detail based on the following figures, wherein.

DETAILED DESCRIPTION

An exemplary embodiment according to the present invention will be described with reference to the drawings, however, the present invention is not limited to the following exemplary embodiment.

In order to make the following description understandable easy, the front-and-rear direction is set to the X-axis direction, the horizontal direction is set to the Y-axis direction, and the up-and-down direction is set to the Z-axis direction. The directions and the sides represented by arrows X, −X, Y, −Y, Z, −Z represent the frontward, rearward, rightward, leftward, upward and donward directions, or the front side, the rear side, the right side, the left side, the upper side and the lower side, respectively.

Furthermore, in the figures, a dot "." in a circle "○" means an arrow directing from the back side to the front side with respect to the paper surface, and a symbol "X" in a circle "○" means an arrow directing from the front side to the back side with respect to the paper surface. In the following description with respect to the drawings, members other than members necessary for description are properly omitted from illustration in order to make the understanding of the exemplary embodiment easy.

Figure 1:
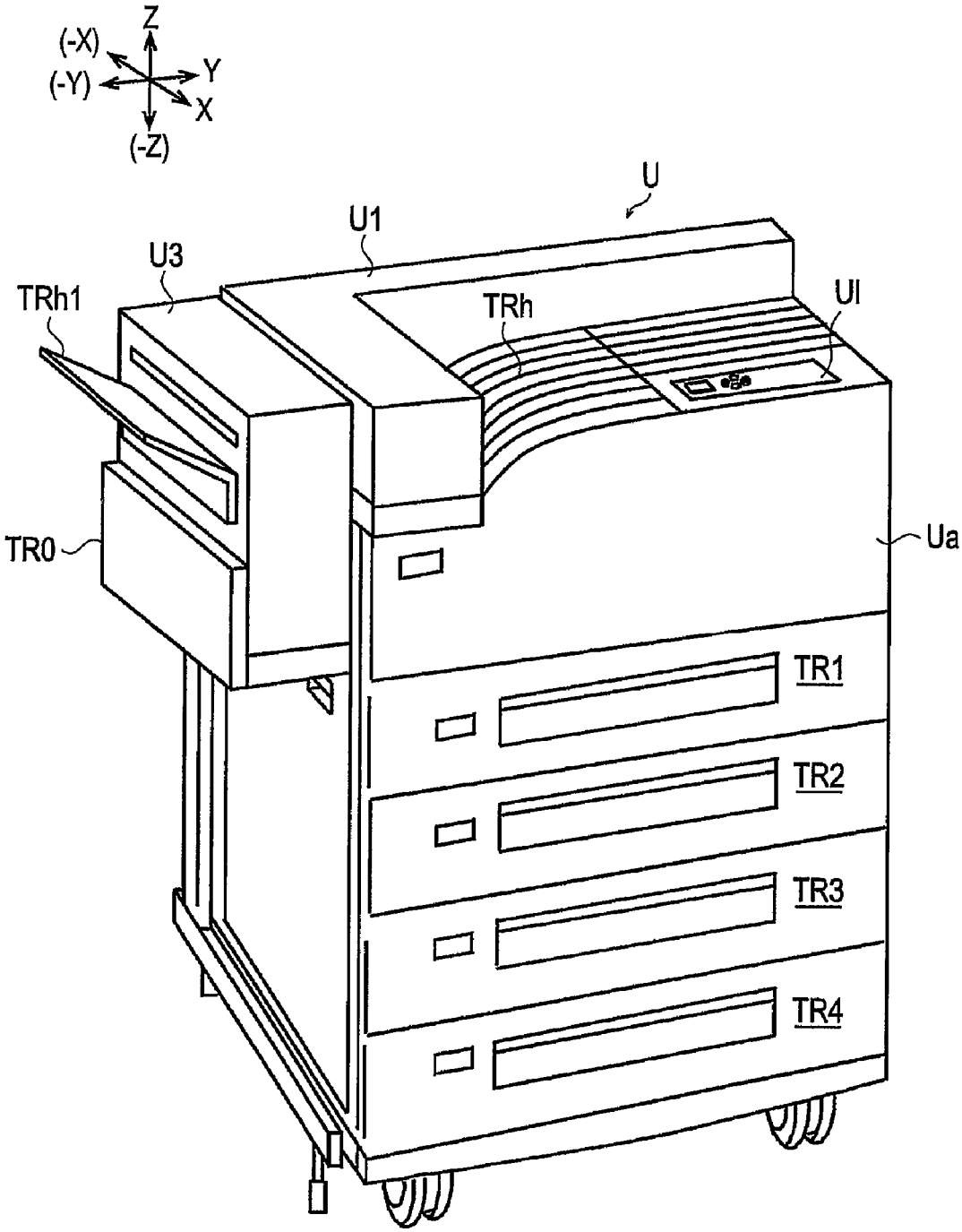
FIG. 1 is a perspective view showing an image forming apparatus according to an exemplary embodiment.

FIG. 1 is a perspective view showing an image forming apparatus according to an exemplary embodiment.

In FIG. 1, a printer U which is an example of the image forming apparatus according to the exemplary embodiment is provided with a first paper discharge tray TRh as an example, a first medium discharge unit, a so-called face-down tray TRh on the upper surface of a printer main body U1. An operating unit UI through which a user executes an input operation is provided to the front portion of the upper surface side at the lead side in the medium discharging direction of the first discharge tray TRh, and a display, etc. are provided on the operating unit UI. A front panel Ua as an example of an opening/closing unit is provided to the front surface of the upper portion of the printer U, and the lower end portion of the front panel Ua is rotatably mounted on the printer U main body through a rotational shaft extending in the horizontal direction. Accordingly, when a toner cartridge as an example of a developing container, a process unit as an example of a visual image forming unit or the like is exchanged, the front panel Ua is opened to exchange these members.

Figure 2:
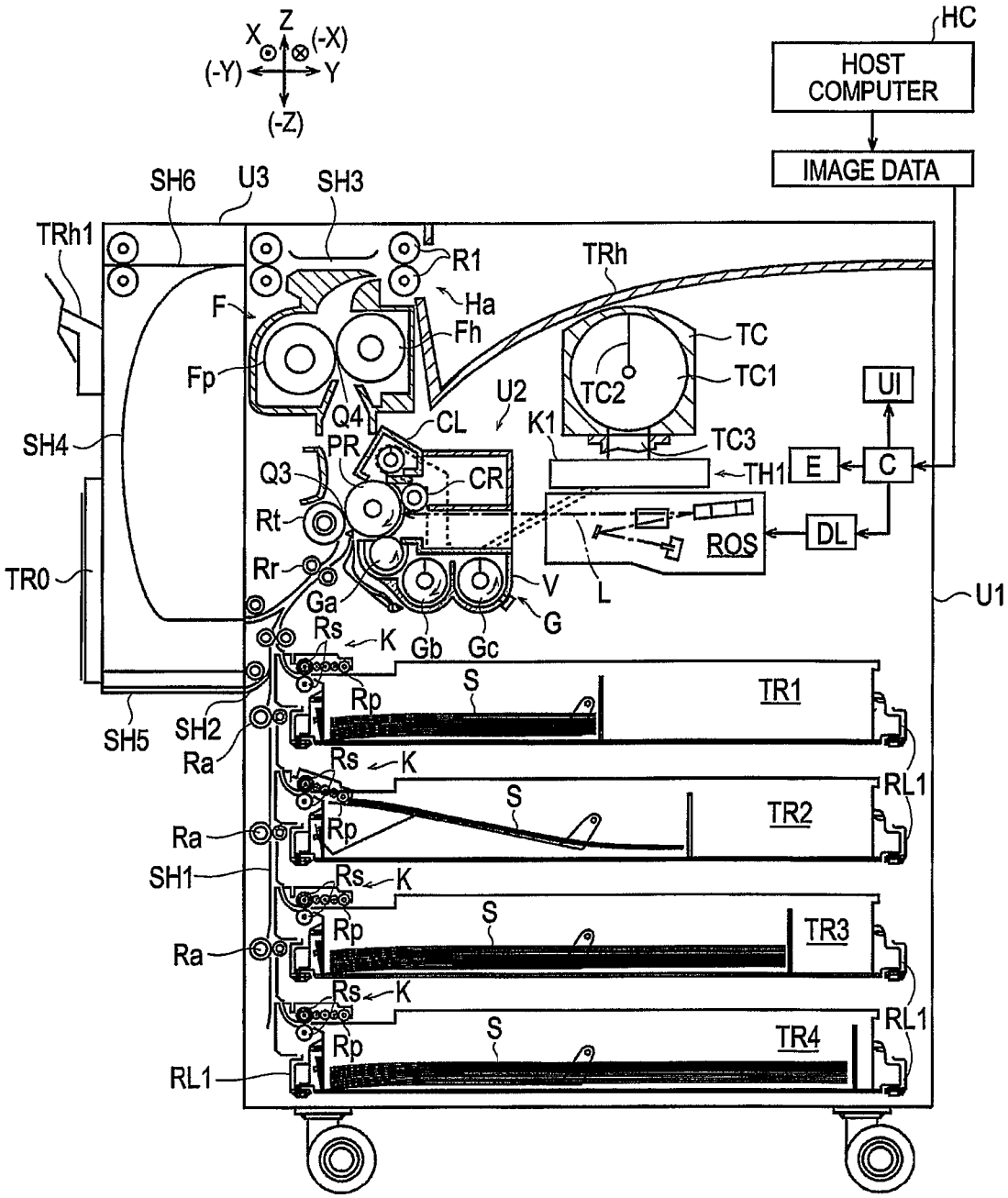
FIG. 2 is a diagram showing the overall image forming apparatus according to the exemplary embodiment.

FIG. 2 is a diagram showing the overall image forming apparatus of the exemplary embodiment.

In FIG. 2, a host computer HC as an example of an image information transmitting device is electrically connected to the printer U, and electrical signals such as image information, a control signal, etc. transmitted from the host computer HC are input to a controller C as an example of the controller of the printer U. The controller C temporarily stores input image information, converts the image information to information for forming a latent image at a preset timing, and outputs the converted image information to a laser driving circuit DL as an example of a latent image forming circuit.

The laser driving circuit DL outputs a driving signal to a latent image forming device ROS in accordance with input information. The operating unit UI, the laser driving circuit DL, a power supply circuit E for applying voltages to a developing roll Ga and a transfer roll Rt described later, etc. are operated under the control of the controller C.

Figure 3:
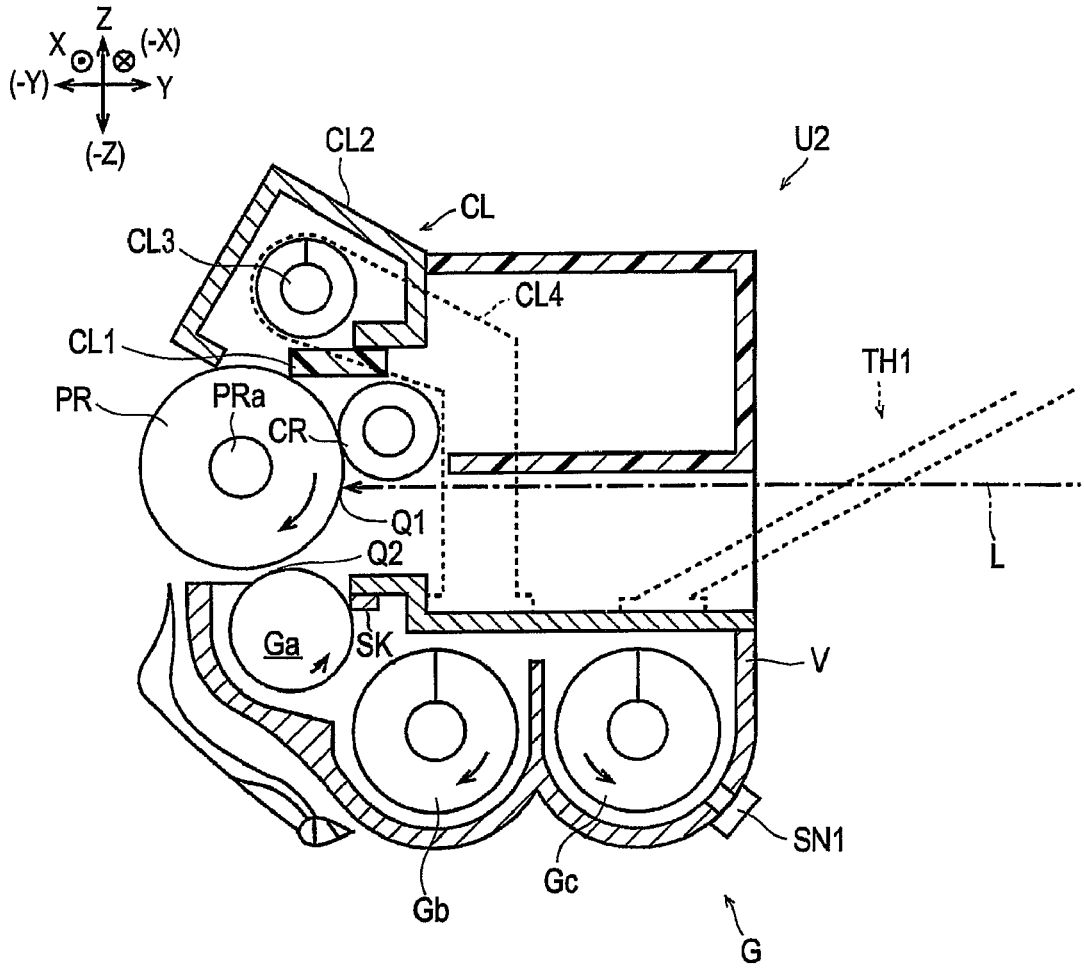
FIG. 3 is an enlarged view of a main part of a toner image forming device of FIG. 2.

FIG. 3 is an enlarged view of a main part of a toner image forming device in FIG. 2.

In FIGS. 2 and 3, a toner image forming device U2 an example of a visible image forming unit for forming a black toner image is disposed at the left side of the latent image forming device ROS. A laser beam L as an example of latent image forming light emitted from the latent image forming device ROS is incident to a rotating photoconductor PR.

In FIGS. 2 and 3, the toner image forming device U2 of this exemplary embodiment has the photoconductor PR as an example of an image carrier rotating in a direction of an arrow around a rotational shaft PRa, a charging roll CR as an example of a charging member, a developing device G and a photoconductor cleaner CL as an example of a cleaning unit for the image carrier. The toner image forming device U2 is designed to be unitized, and it is detachably mounted as a process unit in the main body U1 of the image forming apparatus. The mounting and detaching of the process unit U2 is performed under the state that an openable/closable front cover Ua mounted on the front surface of the main body U1 of the image forming apparatus is opened.

In FIGS. 2 and 3, the surface of the photoconductor PR is charged by the charging roll CR to which a charging voltage is applied, and then exposed and scanned with a laser beam L of the latent image forming device ROS at a latent image writing position Q1 to form an electrostatic latent image. The surface of the photoconductor PR on which the electrostatic latent image is formed is rotationally moved and successively passed through a developing area Q2 and a transfer area Q3.

The developing device G has a developing container V in which toner as an example of developing agent is accommodated. The developing roll Ga as an example of a developing agent carrier which faces the photoconductor PR in the developing area Q2 and to which a developing voltage is applied is rotatably supported in the developing container V. Toner stirring members Gb and Gc for feeding toner to the developing roll Ga while stirring the toner are rotatably mounted in the developing container V. Accordingly, In connection with the rotation of the developing roll Ga, the toner carried on the surface of the developing roll Ga is fed to the developing area Q2, and the electrostatic latent image on the photoconductor PR passing through the developing area Q2 is developed into a toner image as an example of a visible image with the toner.

One end of a supplement path of a cartridge toner supplement device TH1 as an example of a developing agent supplement device fixedly mounted in the printer U is connected to the front end portion of the developing container V. The other end of the supplement path of the cartridge toner supplement device TH1 is connected to a discharge port TC3 of a toner cartridge TC as an example of the developing agent container.

In FIG. 2, the toner cartridge TC has a cartridge main body TC1 as an example of a container main body for accommodating toner therein, and a toner feeding member TC2 as an example of an in-container feeding member is rotatably mounted in the cartridge main body TC1. Accordingly, the toner feeding member TC2 is rotated in accordance with the consumption of toner in the developing device G, and toner in the cartridge main body TC1 is fed to the discharge port TC3. The toner discharged from the discharge port. TC3 is fed to the developing container V of the developing device G by a supplement feeding member (not shown) in the supplement path of the cartridge toner supplement device TH1.

The toner cartridge TC is designed so as to be detachably mounted in the printer U by inserting or pulling out the toner cartridge TC into or from the printer U in the front-and-rear direction. The mounting and detaching of the toner cartridge TC is performed under the state that an openable/closable front cover Ua mounted on the front surface of the main body U1 of the image forming apparatus is opened.

The toner image forming device U2 for forming a toner image on the photoconductor PR is constructed by the photoconductor PR, the charging roll CR, the electrostatic latent image forming device ROS, the developing device G, etc.

In FIGS. 1 and 2, plural sheet supply trays TR1 to TR4 as an example of a medium accommodating unit are provided at the lower portion of the printer U. The plural sheet supply trays TR1 to TR4 accommodate recording sheets S as an example of a medium to be transported to the transfer area Q3.

In FIG. 2, rails RL1 are disposed at the inside of the lower portion of the printer U. The rails RL1 are an example of a container guiding member for movably supporting both the right and left end portions of the sheet supply trays TR1 to TR4 which are inserted or pulled out. Accordingly, Each of the sheet supply trays TR1 to TR4 are supported by a pair of right and left rails RL1 so as to be movable in the front-and-rear direction, and each of the sheet supply trays TR1 to TR4 can be inserted and pulled out through the front surface of the printer U.

In FIG. 2, a sheet supply device K is disposed above each of the sheet supply trays TR1 to TR4. The sheet supply device K has a pickup roll Rp as an example of a medium take-out member, and a handling roll Rs as an example of a handling member constructed by a feed roll as an example of a medium feeding member and a retard roll as an example of a medium separating member.

Recording sheets S picked up by the pickup roll Rp of the sheet supply device K are separated one by one by the handling roll Rs, and fed to the feed path SH1 of the main body. The supplied sheet is fed by each of sheet feeding rolls Ra as an example of plural feeding members disposed in the main body feeding path SH1. The sheet S fed by the sheet feeding roll Ra is fed to a transfer area Q3 by a register roll Rr as an example of a time adjusting member in conformity with a timing at which a toner image on the surface of the photoconductor PR is moved to the transfer area Q3.

A manual feed tray TR0 as an example of a manual feeding unit is mounted at the left side portion of the printer U. A sheet S supplied from the manual feed tray TR0 is passed from an additional feed path SH5 for manual feed through a manual feeding path SH2, fed by each sheet feeding roll Ra of the main body feeding path SH1 and then fed to the transfer area Q3 by the register roll Rr.

In FIG. 2, the transfer roll Rt as an example of the transfer device to which a transfer voltage is applied is disposed in the transfer area Q3. The transfer roll Rt is brought into contact with the photoconductor PR under predetermined pressure in the transfer area Q3, and transfers a toner image on the photoconductor PR to a sheet S passing through the transfer area Q3.

In FIG. 3, after the toner image on the surface of the photoconductor PR is transferred onto the sheet S in the transfer area Q3, residual toner as an example of residual developing agent adhering to the surface of the photoconductor PR is removed and withdrawn from the photoconductor PR by a cleaning blade CL1 as an example of a cleaning member of photoconductor cleaner CL to thereby clean the photoconductor PR. The residual toner removed by the cleaning blade CL1 is accommodated in a cleaner container CL2 as an example of the cleaning container. The developing agent in the cleaner container CL2 is fed frontwards by a withdrawing auger CL3 as an example of a withdrawing feeding member, passed through a withdrawing path CL4 provided at the front end and then returned into the developing container V for recycle.

The photoconductor PR from which the residual toner adhering to the surface of the photoconductor PR is withdrawn by the photoconductor cleaner CL is charged by the charging roll CR again.

The sheet S to which an unfixed toner image is transferred in the transfer area Q3 is fed to a fixing area Q4 of the fixing device F under a non-fixed state. The fixing device F has a heating roll Fh as an example of a heating fixing member, and a pressurizing roll Fp as an example of a pressurizing member. The toner image is heated and fixed in the fixing area Q4 in which the heating roll Fh and the pressurizing roll Fp come into contact with each other.

The toner image forming device U2, the transfer roll Rt and the fixing device F constitute an image recording member U2+Rt+F for recording an image on a sheet S.

A sheet S having a fixed toner image formed thereon is guided by a sheet guide as an example of a medium guide member, and fed to a sheet discharge roll R1 as an example of a sheet discharge member. The sheet S is discharged from a sheet discharge port Ha as an example of a medium discharge port to the first sheet discharge tray Trh by the sheet discharge roll R1.

A main-body-side reversing path SH3 connected to the sheet discharge port Ha is provided above the fixing device F in the printer U. A sheet reversing device U3 as an example of a medium reversing device as an additional device is mounted at the upper side of the manual feed tray TR0. An option sheet reversing path SH4 as an example of an additional reversing path connected to the main-body-side reversing path SH3 is formed in the sheet reversing device U3. Accordingly, in duplex printing, the sheet having the toner image fixed thereon in the fixing area Q4 is passed through the main body sheet reversing path SH3 and the option sheet reversing path SH4, fed to the register roll Rr and then fed to the transfer area Q3 again.

The main-body-side reversing path SH3 and the option sheet reversing path SH4 constitute a reversing path SH3+SH4.

The sheet reversing device U3 is provided with an option sheet discharge tray TRh1, so-called face-up tray TRh1 as an example of an additional medium discharge unit to which a sheet S is discharged with an image recording surface thereof placed face up. An option sheet discharge path SH6 as an example of an additional discharge path is provided between the option sheet discharge tray TRh1 and the main-body-side reversing path SH3. When it is instructed by a user that a sheet S is discharged to the option sheet discharge tray TRh1, the sheet S is passed from the main-body-side reversing path, SH3 through the option sheet discharge path SH6 and then discharged to the option sheet discharge tray TRh1.

Figure 4:
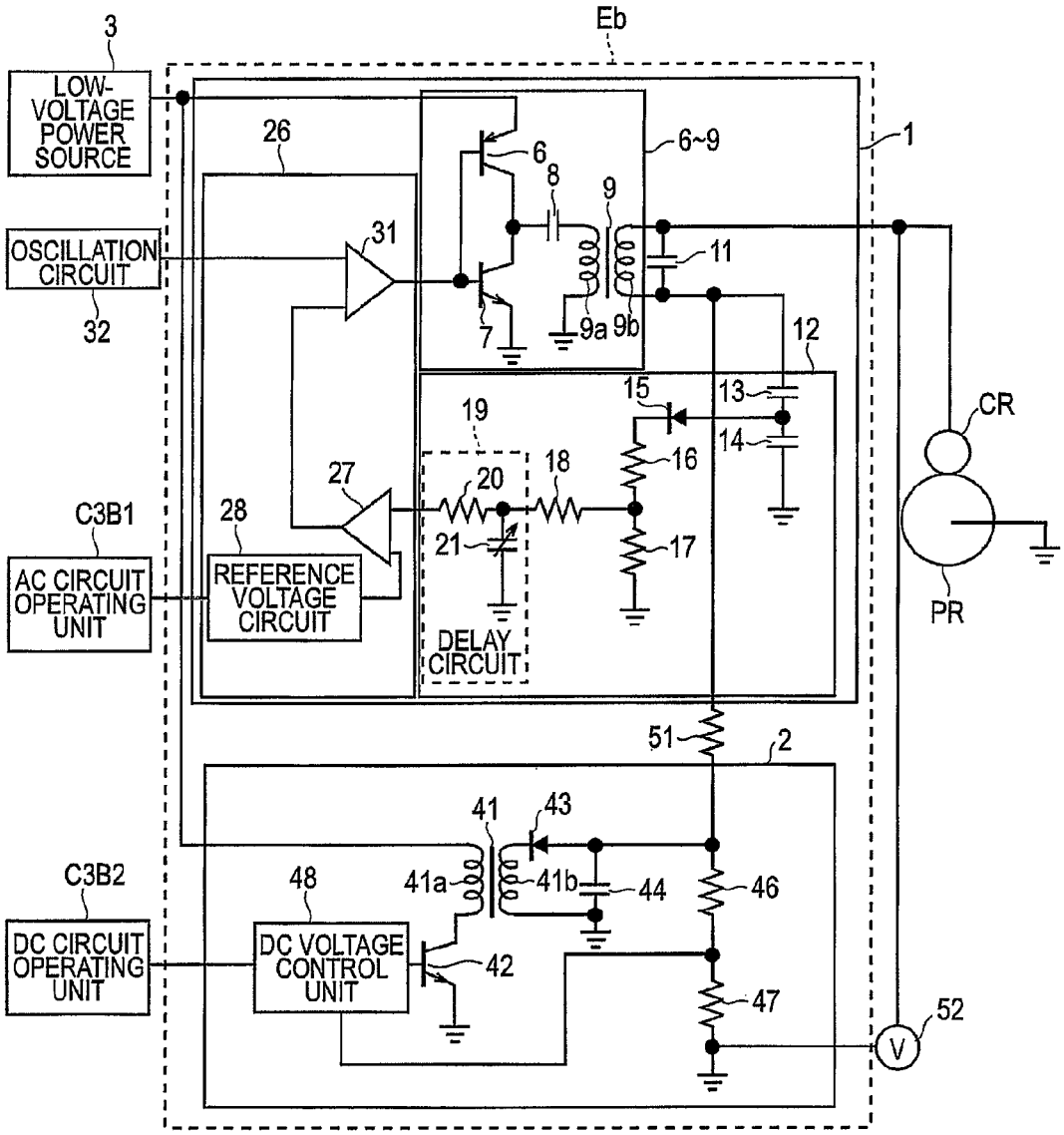
FIG. 4 is a diagram showing a charging power supply circuit for applying a voltage to a charging roll of the exemplary embodiment.

FIG. 4 is a diagram showing a charging power supply circuit for applying a voltage to the charging roll of the exemplary embodiment.

In FIG. 4, a charging power supply circuit Eb as an example of a charging power source for applying a voltage to the charging roll CR has an AC output circuit 1 and a DC output circuit 2.

The AC output circuit 1 has a first transistor 6 whose emitter is connected to a low voltage power source 3 of the printer U. A collector of a second transistor 7 is connected to the collector of the first transistor 6, and the emitter of the second transistor 7 is grounded. One end of a first capacitor 8 is connected to the collector of each of the transistors 6 and 7, the other end of the first capacitor 8 is connected to the primary side 9*a* of a first transformer 9 as an example of a boosting element, and the other end of the primary side 9*a* of the first transformer 9 is grounded. One end of the secondary side 9*b* of the first transformer 9 is connected to the charging roll CR. An AC boosting circuit 6 to 9 of the exemplary embodiment is constructed by the respective elements represented by reference numerals 6 to 9.

A second capacitor 11 is connected to the secondary side 9*b* of the first transformer 9 in parallel. One end of a third capacitor 13 of an AC current detecting circuit 12 is connected to the other end of the secondary side 9*b* of the first transformer 9 in series. One end of a fourth capacitor 14 is connected to the other end of the third capacitor 13 in series, and the other end of the fourth capacitor 14 is grounded.

The anode of a first diode 15 is connected to the other end of the third capacitor 13, and a first resistor 16 is connected to the cathode of the first diode 15 in series. One end of a second resistor 17 is connected to the other end of the first resistor 16 in series, and the other end of the second resistor 17 is grounded. One end of a third resistor 18 is connected to the other end of the first resistor 16 in series, and a delay circuit 19 as an example of a response control circuit is connected to the other end of the third resistor 18.

The delay circuit 19 has a fourth resistor 20 whose one end is connected to the other end of the third resistor 18 in series, and a variable capacitor 21 having variable electrostatic capacitance as an example of a response control element whose one end is connected to the other end of the third resistor 18 in series. Accordingly, the delay circuit 19 of the exemplary embodiment is constructed by a so-called low-pass filter, and the delay corresponding to the electrostatic capacitance occurs by controlling the electrostatic capacitance of the variable capacitor 21. Accordingly, flowing current varies due to variation of the load resistance of the charging roll CR, and even when the variation of the current is detected through the third capacitor 13, etc., the response speed is reduced (i.e., the response is delayed) by the amount corresponding to the above delay.

The AC current detecting circuit 12 of the exemplary embodiment 12 includes the respective elements represented by the reference numerals 13 to 18 and the delay circuit 19. Accordingly, in this exemplary embodiment, the AC current detecting circuit 12 is configured to have the delay circuit 19, however, it may be configured as a discrete and independent element.

The other end of the fourth resistor 20 is connected to the first input side of the first comparator 27 of the AC current control circuit 26. A reference voltage circuit 28 for applying a predetermined reference voltage is connected to the second input side of the first comparator 27. A signal from an AC control unit C3B1 of the controller C is input to the reference voltage circuit 28 to control application or non-application of the reference voltage 28, that is, the ON/OFF operation of the reference voltage circuit 28, thereby controlling the ON/OFF operation of the AC output circuit 1.

The output side of the first comparator 27 is connected to the first input side of the second comparator 31, and the output corresponding to the difference between the input signal from the delay circuit 19 and the reference voltage is input to the first input side of the second comparator 31. An oscillation circuit 32 for outputting a signal based on the frequency of a predetermined AC voltage is connected to the second input side of the second comparator 31.

The output side of the second comparator 31 is connected to the bases of the first and second transistors 6 and 7, and controls the transistors 6 and 7 in accordance with the difference between the signal of the oscillation circuit 32 and the input signal from the first comparator 27 to generate an AC voltage at the secondary side 9*b* of the first transformer 9.

The AC current control circuit 26 of the first exemplary embodiment is constructed by the comparators 27 and 31 and the reference voltage circuit 28. The respective elements represented by the reference numerals 6 to 31 constitute the AC output circuit 1 constructed by the constant-current control circuit.

Accordingly, when the load resistance of the charging roll CR varies, the signal input from the AC current detecting circuit 12 to the first comparator 27 is delayed and varied by the delay circuit 19, and thus the output of the second comparator 31 varies. Accordingly, the current flowing through the primary side 9*a* of the transformer 9 also varies so that the current flowing through the secondary side 9*b* is controlled to be constant.

The DC output circuit 2 has a second transformer 41 having a primary side 41*a* whose one end is connected to the low-voltage power source 3. The other end of the primary side 41*a* of the second transformer 41 is connected to the collector of the third transistor 42, and the emitter of the third transistor 42 is grounded.

One end of the secondary side 41*b* of the second transformer 41 is grounded, and the cathode of a second diode 43 is connected to the other end of the second transformer 41. One end of a fourth capacitor 44 is connected to the anode of the second diode 43, and the other end of the fourth capacitor 44 is grounded. Furthermore, one end of a fifth resistor 46 is connected to the anode of the second diode 43, and the other end of the fifth resistor 46 is connected to one end of a sixth resistor 47. The other of the sixth resistor 47 is grounded.

Furthermore, the one end of the sixth resistor 47 is also connected to a DC voltage control circuit 48, and the DC voltage control circuit 48 outputs a signal to the base of the third transistor 42. A signal from a DC circuit operating unit C3B2 of the controller C is input to the DC voltage control circuit 48 to control operation or non-operation of the DC voltage control circuit 48, that is, ON/OFF of the DC voltage control circuit 48, The DC output circuit 2 of the exemplary embodiment is constructed by the respective elements represented by the reference numerals 41 to 48. Accordingly, when the DC voltage control unit 48 is turned on, the transistor 42 is controlled, and the voltage from the low-voltage power source 3 is boosted in the second transformer 41 and rectified in the second diode 43 and the fourth capacitor 44, so that a DC voltage is output from the DC output circuit 2.

The output of the DC output circuit 2 is connected to the secondary side 9*b* of the first transformer 9 through a seventh resistor 51. Accordingly, the DC voltage output from the DC output circuit 2 is superposed on the AC voltage which is generated in the second transformer 9 of the AC output circuit 2 and subjected to constant-current control (i.e., constant-current-controlled AC voltage) to form a superposed voltage, and the thus-formed superposed voltage is applied to the charging roll CR.

A voltmeter 52 as an example of a variation detecting member for detecting variation of the voltage applied to the charging roll CR is connected to the charging power supply circuit Eb of the exemplary embodiment. The charging roll CR, the charging power supply circuit Eb and the control unit for controlling these elements constitute the charger CR+Eb of this exemplary embodiment.

(Controller of the Exemplary Embodiment)

Figure 5:
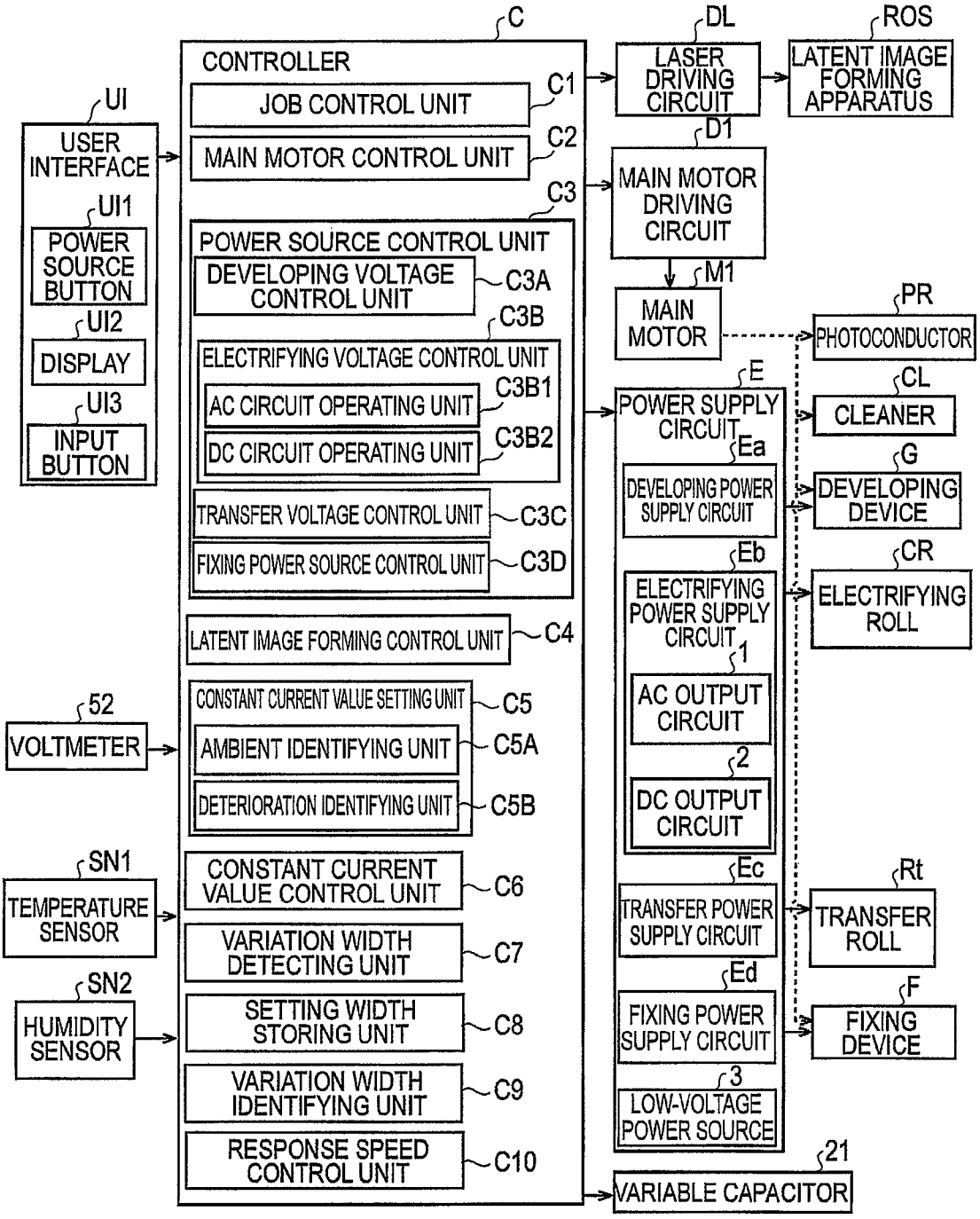
FIG. 5 is a block diagram showing respective functions provided to a controller of the image forming apparatus according to the exemplary embodiment of the present invention.

FIG. 5 is a functional block diagram showing the respective functions of the controller of the image forming apparatus according to the exemplary embodiment.

In FIG. 5, the controller C of the image forming apparatus U of the exemplary embodiment is constructed by a compact information processing device, that is, a so-called microcomputer. The controller C includes I/O for performing input/output of signals from/to the external, adjustment of an input/output signal level, etc., ROM in which programs required to execute necessary processing, data, etc. are stored, RAM for temporarily storing necessary data, HDD, CPU for executing processing corresponding to programs stored in ROM and HDD, a clock oscillator, etc., and the controller C can implement various kinds of functions by executing the programs stored in ROM.

(Signal Input Element connected to Controller C)

Output signals from signal output elements such as the operating unit U1, the voltmeter 52, a temperature sensor SN1, a temperature sensor SN2, etc. are input to the controller C.

The operating unit U1 has a power button UI1 for turning on or off the power source of the printer U, a display UI2, various kinds of input buttons UI3 such as an arrow key as an example of a direction input button, etc. The voltmeter 52 measures the voltage applied to the charging roll CR. The temperature sensor SN1 detects the ambient temperature of the printer U. The temperature sensor SN2 detects the ambient temperature of the printer U.

(Control Target Elements connected to Controller C)

The controller C outputs control signals for the following control target elements DL, D1 and E. DL represents a laser driving circuit. The laser driving circuit DL controls the latent image forming device ROS to form a latent image on the surface of the photoconductor PR. D1 represents a main motor driving circuit. The main motor driving circuit D1 as an example of a main driving source driving circuit drives a main motor M1 as an example of a main driving source to rotate the photoconductor PR, etc.

E represents a power supply circuit. The power supply circuit E has a developing power supply circuit Ea, a charging power supply circuit Eb, a transferring power supply circuit Ec, a fixing power supply circuit Ed, the low-voltage power source 3, etc.

The developing power supply circuit Ea applies a developing voltage to the developing roll Ga of the developing device G. The charging power supply circuit Eb has the AC output circuit 1 for outputting a constant-current-controlled AC voltage and the DC output circuit 2 for outputting a DC voltage, and applies a voltage to the charging roll CR. The transferring power supply circuit Ec applies a transfer voltage to the transfer roll Rt. The fixing power supply circuit Ed supplies heater heating power to the heating roll Fh of the fixing device F.

(Function of Controller C)

The controller C has functions of executing the processing corresponding to input signals from the signal output elements and outputting control signals to the respective control target elements. That is, the controller C has the following functions: a job control unit C1, an main motor control unit C2, a power source control unit C3, a latent image forming control unit C4, a constant current value setting unit C5, a constant current value control unit C6, a variation range detecting unit C7, a setting range storing unit C8, a variation range identifying unit C9, and a response speed control unit C10. These units will be described hereunder in detail.

The job control unit C1 as an example of an image forming control unit controls the operation of the charging roll CR, the transfer roll Rt, the fixing device F, etc. in accordance with the received image information to execute a job as an example of the image forming operation.

The main motor control unit C2 as an example of a main driving source control unit controls the operation of the main motor M1 through the main motor driving circuit D1 to control the driving of the developing device G, the heating roll Fh of the fixing device F, the sheet discharge roll Rh, etc.

The power source control unit C3 has a developing voltage control unit C3A, a charging voltage control unit C3B, a transfer voltage control unit C3C and a fixing power source control unit C3D, and controls the operation of the power supply circuit E to control voltage or power supply to the respective members.

The developing voltage control unit C3A controls the developing power supply circuit Ea to control application of the developing voltage Vb to the developing roll Ga of the developing unit G. The charging voltage control unit C3B has the AC circuit operating unit C3B1 for operating the AC output circuit 1, and the DC circuit operating unit C3B2 for operating the DC output circuit 2, and controls the charging power supply circuit Eb to control application of the charging voltage VH to the charging roll CR. The transfer voltage control unit C3C controls the transfer power supply circuit Ec to control the transfer voltage Vt to be applied to the transfer roll Rt. The fixing power source control unit C3D controls the fixing power supply circuit Ed to control ON/OFF of the fixing device F, thereby controlling the fixing temperature.

The latent image forming control unit C4 controls the latent image forming device ROS through the laser driving circuit DL to form an electrostatic latent image on the surface of the photoconductor PR.

The constant current value setting unit C5 has an ambient identifying unit C5A for identifying an atmosphere such as low-temperature and low-humidity or the like on the basis of detection results of the temperature sensor SN1 and the humidity sensor SN2, and a deterioration identifying unit C5B for identifying the degree of deterioration due to use of the photoconductor PR on the basis of the accumulated number of printed sheets. The constant current value setting unit C5 sets a constant current value on the basis of the atmosphere such as temperature, humidity, etc. of the charging roll CR or the deterioration caused by use of the photoconductor PR when the AC voltage to be applied to the charging roll CR is subjected to constant current control. Techniques of controlling the constant current value in accordance with temperature and humidity or deterioration caused by use of the photoconductor PR, that is, variation of the film thickness of the photoconductor PR are described in various publications such as JP-A-2007-218977, JP-A-2007-218978, JP-A-2008-164737, JP-A-2004-333789, JP-A-2004-62062, etc. These techniques are well known, various configurations can be adopted, and thus the detailed descriptions thereof are omitted.

On the basis of the constant current value set in the constant current value setting unit C5, the constant current value control unit C6 controls the constant current value which is subjected to constant current control in the AC output circuit 1. The constant current value control unit C6 of the exemplary embodiment controls the reference voltage of the reference voltage circuit 28, thereby changing and controlling the constant current value.

The variation range detecting unit C7 detects the variation range of the AC voltage which varies in accordance with the electrical resistance of the charging roll CR. The variation range detecting unit C7 of the exemplary embodiment detects, as a variation range, the difference between maximum value and the minimum value of the inter-peak voltage for the inter-peak voltage Vpp of the AC voltage of ten periods, for example.

The setting range storing unit C8 stores a preset setting range for identifying whether the variation range is large or not. In the exemplary embodiment, 0.1 [kV] is stored as an example of the setting range. The variation range identifying unit C9 identifies whether the variation range detected by the variation range detecting unit C7 is equal to the setting range or less.

The response speed control unit C10 reduces the response speed of the variation of the AC voltage with respect to the electrical resistance of the charging roll CR when the variation range is larger than the set range. The response speed control unit C10 of the exemplary embodiment controls the value of the electrostatic capacitance of the variable capacitor 21 to change the response speed. In the response speed control unit C10 of the exemplary embodiment, the response speed is set and controlled with the higher speed of the response speed set as an initial value every time the constant current value is set. In the exemplary embodiment, when the variation range is larger than the set range, the electrostatic capacitance of the variable capacitor 21 is set so that 10 [PF} corresponds to one stage, and the response speed is controlled to be reduced every stage.

(Flowchart of Exemplary Embodiment)

Next, the flow of the processing of the image forming apparatus U according to the exemplary embodiment will be described with a so-called flowchart.

(Flowchart of Response Speed Control Processing)

Figure 6:
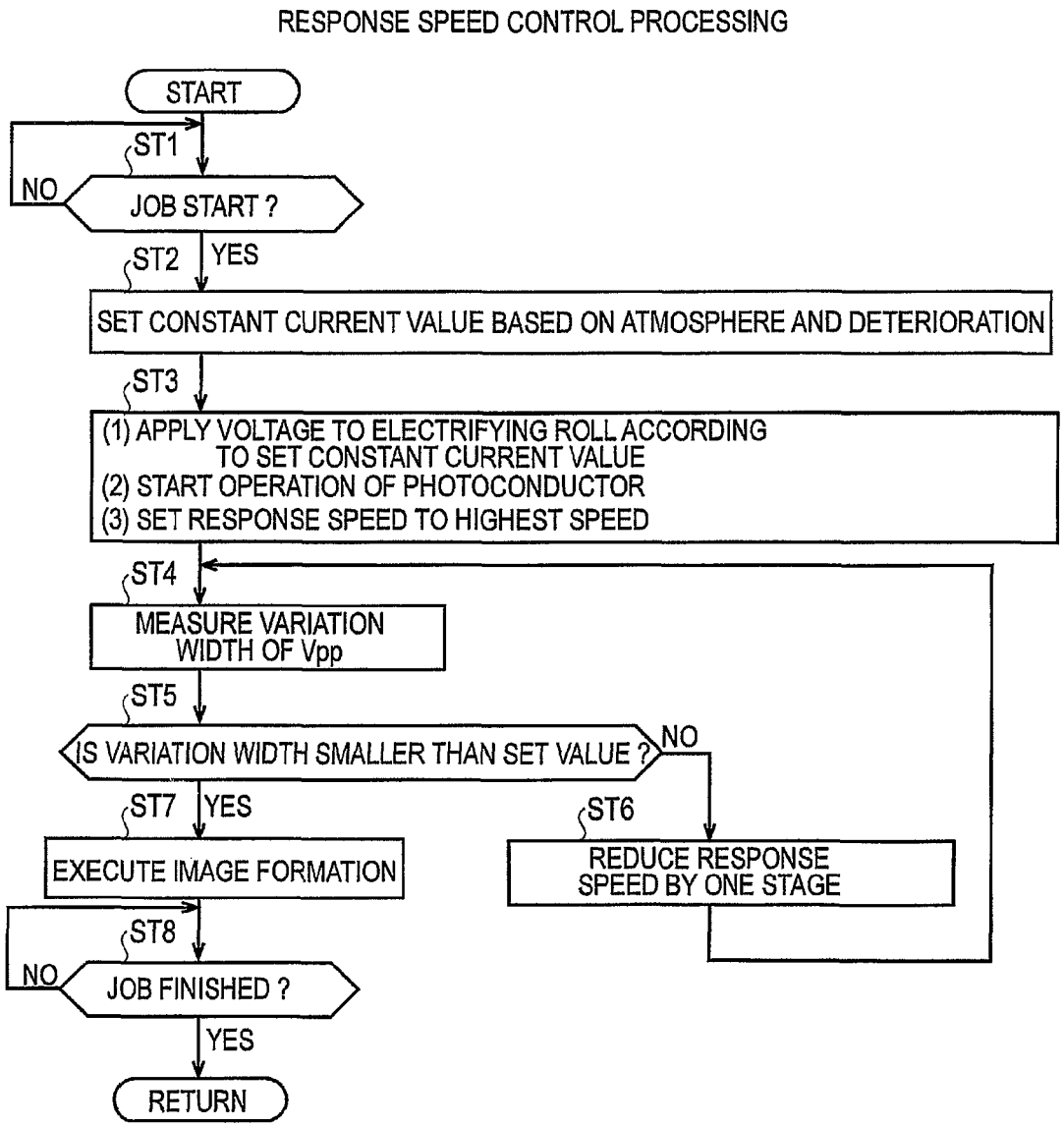
FIG. 6 is a flowchart showing response speed control processing of the exemplary embodiment.

FIG. 6 is a flowchart showing the response speed control processing of the exemplary embodiment.

The processing of the respective steps (ST) of the flowchart of FIG. 6 is executed according to the program stored in the hard disk or the like of the controller C of the printer U. This processing is executed in parallel to the other kinds of processing of the printer U. The flowchart shown in FIG. 6 is started when the power of the printer U is turned on.

In ST1 of FIG. 6, image information or the like is received, and it is determined whether the job as the image forming operation is started or not. In case of "YES" (Y), the processing goes to ST2. On the other hand, in case of "NO" (N), the step ST1 is repeated.

In ST2, the constant current value to be used for the constant current control of the charging roll CR is set on the basis of the atmosphere and the deterioration. Then, the processing goes to ST3.

In ST3, the following kinds of processing (1) to (3) are executed, and then the processing goes to ST4.

(1) The charging power supply circuit Eb is controlled in accordance with the set constant current value, and a voltage is applied to the charging roll CR.

(2) The operation of the photoconductor PR is started.

(3) The variable capacitor 21 is controlled to initialize and set the response to the highest speed.

In ST4, the variation range of Vpp is measured, and the processing goes to ST5. In ST5, it is determined whether the variation range is smaller than the set range or not. In case of "NO", the processing goes to ST6. In case of "YES", the processing goes to ST7. In ST6, the response speed is reduced by one stage. That is, the response is delayed. Then, the processing returns to ST4.

In ST7, the image forming operation is executed on the basis of the set constant current value and response speed, and then the processing goes to ST8. In ST8, it is determined whether the job is finished or not. In case of "NO", the processing of ST8 is repeated. In case of "YES", the processing returns to ST1.

(Action of Exemplary Embodiment)

In the printer U of the exemplary embodiment having the above configuration, the charging voltage obtained by superposing the DC voltage on the constant-current-controlled AC voltage is applied from the charging power supply circuit Eb to the charging roll CR when the image forming operation is executed. At this time, when the variation range of the AC voltage varying in accordance with the load variation of the charging roll CR is large, the response speed is reduced.

The electrical resistance of the charging roll CR may vary in accordance with the shape, the atmosphere, dispersion of the electrical resistivity in the peripheral direction of the roll or the like, and thus the flowing current may locally vary. At this time, with respect to AC current which is subjected to constant current control (i.e., the constant-current controlled AC current), when flowing current varies, the variation of the current detected by the AC current detecting circuit 12 is converted to a voltage value, and then input to the delay circuit 19 to keep the constant current value. In the delay circuit 19, an input is delayed and then output. The constant current is controlled to be kept in the AC control circuit 26 receiving the output of the delay circuit 19, and as a result the inter-peak voltage is varied. At this time, the delay of the response in the delay circuit 19 corresponds to the response speed, and the variable capacitor 21 is controlled, thereby controlling the response speed.

Figure 7:
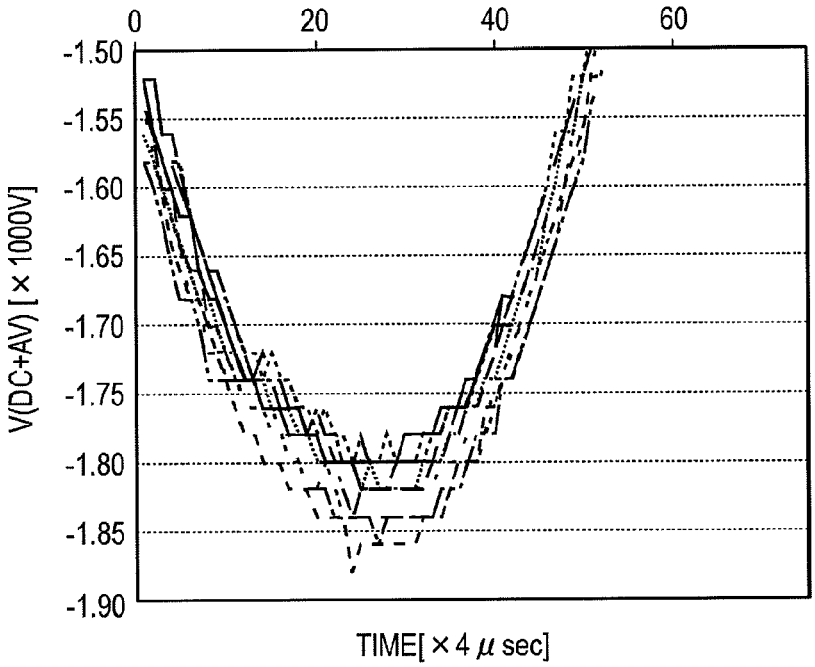
FIG. 7 is a diagram showing an example of the variation corresponding to a half period of an AC voltage when a response speed in the exemplary embodiment is high, and also shows a graph in which the abscissa axis represents the time and the ordinate axis represents a voltage obtained by superposing a DC voltage on the AC voltage.

FIG. 7 is a diagram showing an example of the variation corresponding to a half period of the AC voltage when the response speed is high in the exemplary embodiment, and shows a graph which the abscissa axis represents the time and the ordinate axis represents the voltage value (superposed voltage value) obtained by superposing the DC voltage on the AC voltage.

Figure 8:
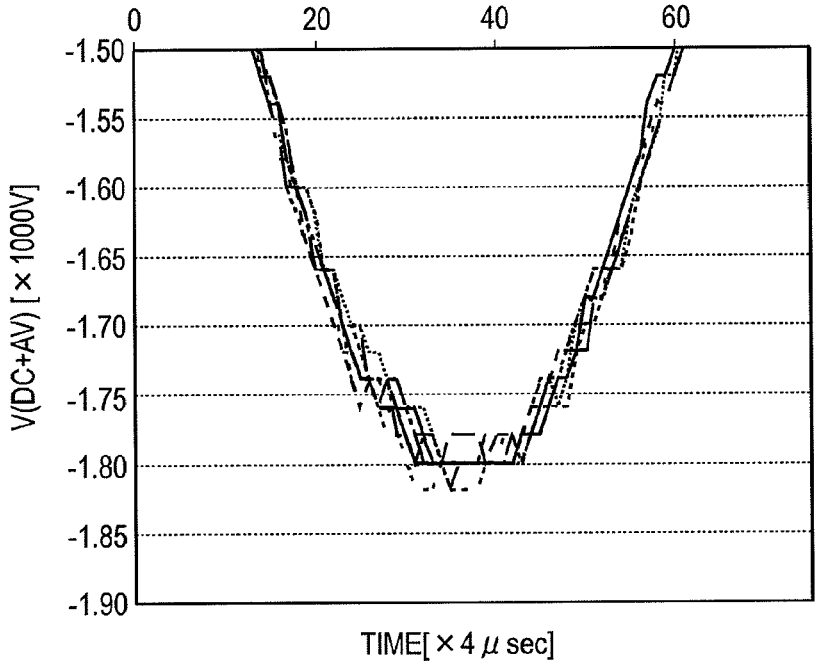
FIG. 8 is a diagram showing an example of the variation corresponding to the half period of the AC voltage when the response speed of the exemplary embodiment is low, and also shows a graph in which the abscissa axis represents the time and the ordinate axis represents a voltage obtained by superposing a DC voltage on the AC voltage.

FIG. 8 is a diagram showing an example of the variation corresponding to a half period of the AC voltage when the response speed is low in the exemplary embodiment, and shows a graph in which the abscissa axis represents the time and the ordinate axis represents the voltage value (superposed voltage value) obtained by superposing the DC voltage on the AC voltage.

Figure 9:
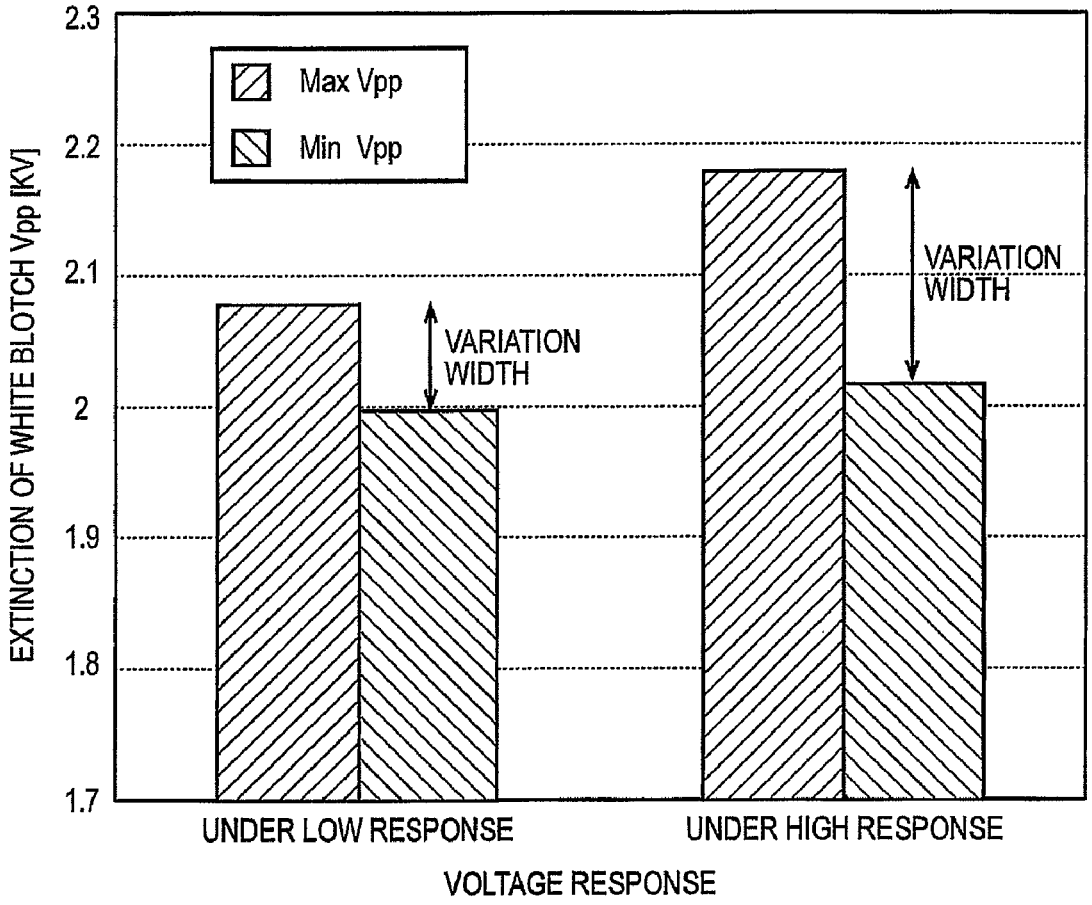
FIG. 9 is a diagram showing the relationship between the response speed and the variation range of an inter-peak voltage, and shows a graph in which the ordinate axis represents the inter-peak voltage.

FIG. 9 is a diagram showing the relationship between the response speed and the variation range of the inter-peak voltage, and shows a graph in which the ordinate axis represents the inter-peak voltage.

In FIG. 7, when the response speed is high, the superposed voltage quickly responds to the variation of the electrical resistance of the charging roll CR, and varies minutely, precisely and frequently. However, the superposed voltage excessively responds to a local variation, and has a dispersion from about −1.80 [kV] to −1.87[kV] at the extreme value. On the other hand, in FIG. 8, when the response speed is low, the response is late. Furthermore, the superposed voltage cannot respond to the local variation, and has a dispersion from about −1.80 [kV] to −1.82 [kV] at the extremal value.

When the DC voltage components are excluded from the results of FIGS. 7 and 8 and the inter-peak voltage Vpp corresponding to one period of the AC voltage is calculated, a result of FIG. 9 is obtained. In FIG. 9, when the response speed is high as shown in FIG. 7, Vpp is equal to 2.02 [kV] at minimum and 2.18 [kV] at maximum, and the variation range is equal to 0.16 [kV]. On the other hand, when the response speed is low as shown in FIG. 8, Vpp is equal to 2.0 [kV] at minimum and 2.08 [kV] at maximum, and the variation range is equal to 0.08 [kV].

When the charging roll CR charges the photoconductor PR, an image defect such as a white blotch, a void or the like which is caused by charging failure is greatly dependent on the minimum value of Vpp, and it is necessary that the minimum value of Vpp is controlled and set to a value or more at which the white block, etc. do not occur.

Here, when the variation range of Vpp is large, that is, when the difference between the maximum Vpp and the minimum Vpp is large, the minimum Vpp must be increased to prevent occurrence of white blotches. However, when the minimum Vpp is increased, the maximum Vpp is also increased. The load imposed on the photoconductor which is caused by discharge, so-called discharge stress is increased by the maximum VPP which must be increased as described above.

On the other hand, when the variation range of Vpp is small, that is, when the difference between the maximum Vpp and the minimum Vpp is small, even if the minimum Vpp is increased to eliminate white blotches, the increasing degree of the maximum Vpp due to the increase of the minimum Vpp is smaller than the case where the variation range is large. Accordingly, when the variation range is reduced, the discharge stress is suppressed.

Here, in the exemplary embodiment, the response speed is controlled in accordance with the variation range. When the variation range is excessively large, the response speed is reduced, and the average of Vpp is reduced. Accordingly, as compared with a case where the response speed is not controlled, the variation range is suppressed from excessively increasing, and thus the discharge stress to the photoconductor PR is suppressed from increasing.

Accordingly, in the exemplary embodiment, as compared with the configuration that the response speed is not controlled in accordance with the variation range, the average value of Vpp applied to the charging roll CR is suppressed from needlessly increasing while preventing occurrence of an image defect of a white blotch or the like.

(Modifications)

The present invention is not limited the above-described exemplary embodiment, and various modifications may be made to the above-described exemplary embodiment. For example, the following first to fifth modifications may be made to the above-described exemplary embodiment of the present invention.

First Modification

In the above-described exemplary embodiment, the printer U is used as an example of the image forming apparatus. However, the present invention is not limited to the printer U, and the present invention may be applied to a copying machine, FAX, a multifunction machine having these plural functions, etc. Furthermore, the present invention is not limited to a monochromatic image forming apparatus, and may be applied to a multi-color, so-called color image forming apparatus.

Second Modification

In the above-described exemplary embodiment, a charging roll cleaner may be provided as a cleaning member for cleaning the charging roll CR.

Third Modification

In the above-described exemplary embodiment, the setting of the constant current value and the control of the response speed are performed every time a job is executed. However, the control timing of the response speed is not limited to the above style. For example, the setting and control of the response speed may be performed on the basis of any condition, for example, it may be performed only when the power of the printer U is turned on, when the operation state of the image forming apparatus is restored from a power saving state, so-called a standby mode, every time a preset number of sheets are printed, only when the constant current value is changed, or the like. The same may be applied to the control timing of the constant current value.

Fourth Modification

In the above-described exemplary embodiment, the configuration of the charging power supply circuit Eb is not limited to that shown in the figures, and it may be arbitrarily modified in accordance with the design, the specification or the like. Furthermore, the configuration of the delay circuit is not limited to that shown in the figures, and it may be arbitrarily modified. Particularly, the configuration of controlling the response speed is not limited to the configuration of the variable capacitor, and any configuration that is added with another element such as a variable resistor or the like and can control the response speed may be adopted.

Fifth Modification

In the exemplary embodiment, the specific numeral values, the material names, etc. may be properly changed in accordance with the design, the specification, etc.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the skilled in the art to understand the invention for various embodiments and with the various modifications as are suited to the particular use contemplated. It is intended that the scope of the invention be defined by the following claims and their equivalents.

What is claimed is:

1. A charging device, comprising:

a charging member that faces an image carrier and charges a surface of the image carrier;

a charging voltage controller that controls a charging voltage to be applied to the charging member when the surface of the image carrier is to be charged, and applies the charging voltage obtained by superposing an AC voltage which is subjected to constant-current control on a DC voltage;

a variation range detector that detects a variation range of the AC voltage which changes according to a characteristic change of the charging member; and a response speed controller that reduces a response speed for the variation of the AC voltage in correspondence with the characteristic change when the variation range is larger than a predetermined set value.

2. An image forming apparatus, comprising:

an image carrier;

the charging device that charges a surface of the image carrier according to claim 1;

a latent image forming device that forms a latent image on the charged surface of the image carrier;

a developing device that develops the latent image on the surface of the image carrier into a visible image;

a transfer device that transfers the visible image on the surface of the image carrier onto a medium; and a fixing device that fixes the visible image on a surface of the medium.

* * * * *